US006406365B1

(12) United States Patent
Ueno

(10) Patent No.: US 6,406,365 B1
(45) Date of Patent: Jun. 18, 2002

(54) SANDING TOOL

(75) Inventor: Makoto Ueno, Tagajyou (JP)

(73) Assignee: Uegaki, Tateo, Sendai (JP)

( * ) Notice: Subject to any disclaimer, the term of this patent is extended or adjusted under 35 U.S.C. 154(b) by 0 days.

(21) Appl. No.: 09/584,214

(22) Filed: May 31, 2000

(30) Foreign Application Priority Data

Jun. 2, 1999 (JP) ..... 11-155816

(51) Int. Cl.[7] ..... B24B 15/00

(52) U.S. Cl. ..... 451/523; 451/524; 451/495; 451/514

(58) Field of Search ..... 451/523, 524, 451/557, 495, 344, 347, 514

(56) References Cited

U.S. PATENT DOCUMENTS 1,724,661 A * 8/1929 Johnson ..... 451/523
2,445,599 A * 7/1948 Bowen ..... 451/523
2,446,183 A * 8/1948 Larson ..... 451/523
5,140,785 A * 8/1992 Eleouet ..... 451/523
5,690,547 A * 11/1997 Holland, Jr. et al. ..... 451/523
6,120,365 A * 9/2000 Johnson ..... 451/523

* cited by examiner

*Primary Examiner*—Eileen P. Morgan
(74) *Attorney, Agent, or Firm*—Burr & Brown

(57) ABSTRACT

The present invention relates to a sanding tool, and more particularly to a sanding tool for smoothing a repair surface. A sanding tool according to the invention is for sanding a surface of a target plane to be repaired into a predetermined condition, which is composed of a base plate, on the front face side of which sandpaper can be stretched, and movable base plates being disposed bendably on opposite sides of the base plate and on each front face side of the movable base plate, sandpaper can be stretched. The movable base plates are resiliently energized in a direction wherein the surface of the base plate becomes flush with the surfaces of the movable base plates, respectively. According to a sanding tool of the present invention, a surface to be repaired can be sanded by an easy operation to obtain a good finish, even if an operator is not skilled.

6 Claims, 6 Drawing Sheets

SANDING TOOL

BACKGROUND OF THE INVENTION

1. Field of the Invention

The present invention relates to a sanding tool, and more particularly to a sanding tool for making a surface to be repaired into a flat surface.

2. Prior Art

A procedure for repairing flaws and dents on a painted surface in a vehicle such as an automobile is as follows. As shown in FIG. 10, a primer 51, a surfacer 52, and paint 53 which have been applied on a steel sheet 50 are first removed, and then, a dent is filled with a putty 1 or the like in an amount somewhat larger than a volume of the dent.

Thereafter, a surface (a part damaged) filled with the putty 1 or the like is sanded to make the same flush with a surface of the vehicle body as shown in FIG. 11. This step for the procedure is sanding the surface filled with a putty so as to flatten the same by the use of sandpapers belonging to several degrees extending over coarse grains to fine grains. In this respect, it is no exaggeration to say that a result of final repair is decided by a skill relating to this step.

A tool used for the sanding treatment has a structure wherein a sandpaper is exchangeably stretched on a base plate 54 having a rectangular flat surface as shown in FIG. 11. The base plate 54 is provided with a grip 55 on the top thereof, and sanding operation is carried out by an operator while holding the grip 55 with an operator's hand (or hands) in reciprocating or circular motion or the like.

Although it seems a reasonable conclusion that since the base plate 54 has a flat surface, an irregular putty surface can be sanded into a flat surface. In reality, however, when such a putty surface is sanded, a flat surface cannot be necessarily realized. This is because the base plate 54 is held by a human hand so that the base plate 54 performs a kind of a wooden pestle motion, and it results in a very slight irregular surface. Moreover, such tendency increases because a sanding operation is principally carried out with a peripheral part of the base plate 54.

In this connection, for eliminating such disadvantage, it is considered that an irregular surface, particularly a convex surface in a putty-filled surface is sanded with the use of an edge portion of the base plate 54 (by inclinedly holding the base plate 54) to smoothen the irregular surface.

However, since the edge portion of the base plate 54 is not a plane, but a linear configuration, as a matter of course, an area of the edge portion being in contact with the putty surface is extremely small. Accordingly, even when an operator intends to execute such a suitable operation while maintaining a sanding tool at a pertinent angle in order to obtain a smooth sanded surface, there is insufficient stability, so that high skill is required to achieve good operation.

Besides, there is also such a problem of easily wearing off sandpaper occupying the edge portion thereof.

SUMMARY OF THE INVENTION

An object of the present invention is to provide a sanding tool with which a surface to be repaired can be sanded into a flat surface by a comparatively easy operation.

Another object of the invention is to provide a sanding tool with which a surface to be repaired can be sanded into a flat surface for a short period of time, and in addition, stable feeling in operation therefor can be provided.

Still another object of the invention is to provide a sanding tool in which local excessive wear of sandpaper is prevented.

A further object of the invention is to provide a sanding tool having good operability at a low cost.

The subject matter of the invention resides in a sanding tool for sanding a surface of apart to be repaired into a prescribed condition, characterized in that it is provided with a base plate on the front surface side on which can be stretched sandpaper, and a movable base plate which is disposed bendably at the end of the base plate and on the front face side of which can be stretched sandpaper; and the movable base plate is energized resiliently in a direction wherein the surfaces of the movable plate become flush with the surface of the base plate.

A movable range of the movable base plate may be arranged to be bent at an angle which has been previously established within a range extending from the same plane with that of the base plate (zero degrees) to an angle of 10 degrees with respect to the base plate.

Moreover, a resilient means may be disposed between the base plate and the movable base plate.

As the resilient means described above, a coil spring or the like is suitable, and it may arranged to specify a positional relationship between the movable base plate and the base plate, whereby the movable base plate becomes flush with the base plate, in the case when no external force is applied to these plates.

A preferred contour of the base plate is rectangular, and the longer side of the base plate is preferably hinged to the movable base plate. Moreover, movable base plates are preferably hinged to opposite sides (both the longer sides) of the base plate, respectively. In addition, it is preferred that the movable base plate is formed into a smaller size than that of the base plate.

Furthermore, a grip may be attached to the top of the base plate such that an operator can execute an operation of the sanding tool by holding the same with his (or her) hand(s). Further, it is also possible to apply the sanding tool to an electrically-driven device or the like which will produce vibrations or will suck dust through an attachment.

According to the present invention, a sanding tool thereof is constituted such that movable base plates are disposed on the opposite ends of a base plate, and when a movable base plate side is pressed, it is bent upwardly with respect to the base plate (or the base plate is bent upwardly with respect to the movable base plate). Thus, it is possible that an edge portion of the sanding tool is allowed to be in contact with a surface to be repaired as a plane in a condition where the sanding tool is allowed to bend.

For this reason, even if a surface to be repaired has been in a fine irregular surface, such irregular surface can be efficiently sanded, so that the surface to be repaired can be sanded into a flat surface with a comparatively easy operation.

Furthermore, in accordance with the present invention, it becomes possible to provide a sanding tool which brings about a feeling of stable operation, and at the same time, by which a surface to be repaired can be sanded into a flat surface in a short period of time.

Moreover, since sandpaper used in a sanding tool according to the present invention is in contact with a surface to be repaired in a plane, it is possible to prevent local excessive wear of the sandpaper, so that a life of the sandpaper can also be prolonged.

In addition to the above description, it is possible to provide a sanding tool having good operability at a low cost according to the present invention.

The present inventor has found in the case where a surface to be repaired is sanded with a sanding tool that when a sort of dot sanding is continued, it brings about a sort of linear sanding, and further when a sort of linear sanding is continued, it brings about a sort of planar sanding. In other words, when it is intended to perform planar sanding at a blast (sanding over a wide area at a blast), it is difficult to carry out a fine sanding operation. In this respect, when a sanding tool according to the present invention is used, stable linear sanding can easily be continuously carried out, so that an extremely good finish can be realized over the whole surface to be repaired for a short period of time.

In this connection, even if a surface to be repaired is a curved surface, a good sanding operation can be easily effected in accordance with a sanding tool of the present invention.

DETAILED DESCRIPTION OF THE PREFERRED EMBODIMENTS

Figure 1:
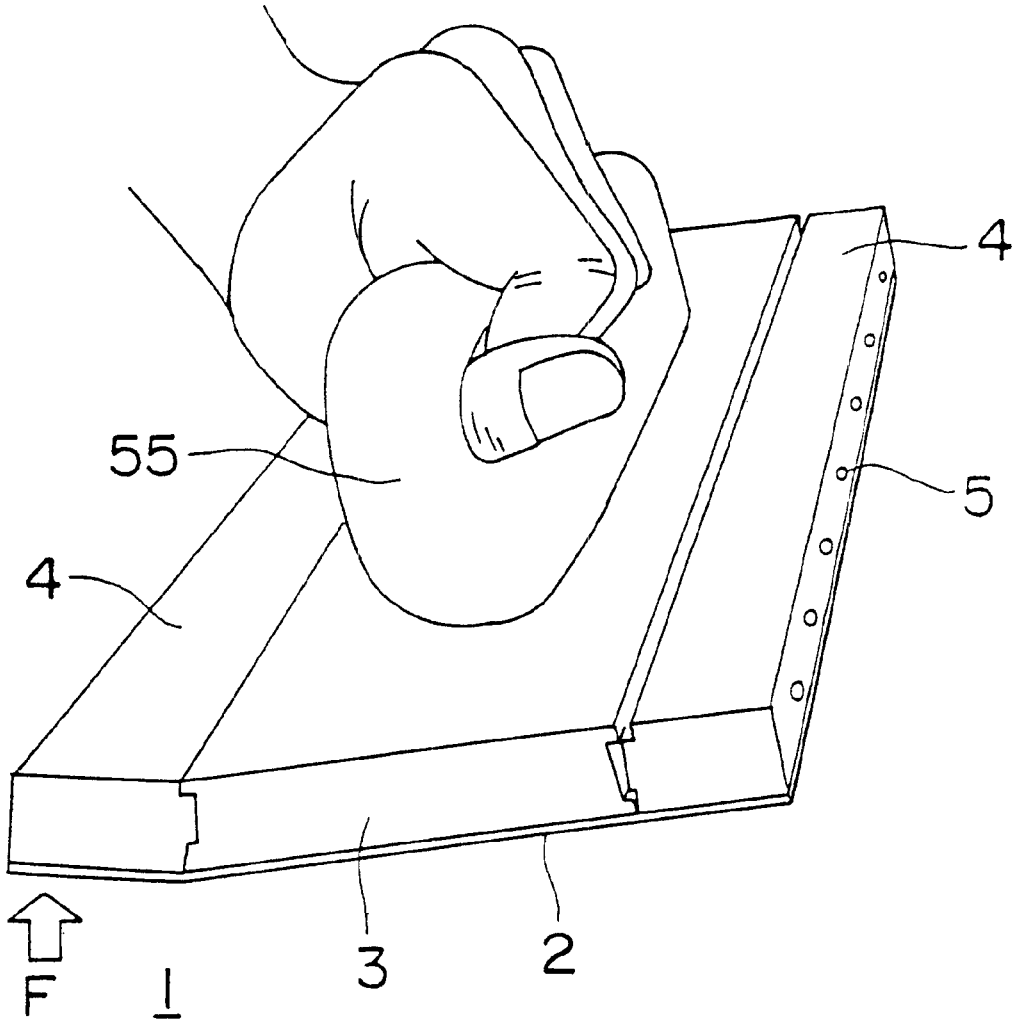
FIG. 1 is a perspective view showing the entirety of a sanding tool according to an embodiment of the present invention.

The present invention will be described in detail hereinafter by referring to the accompanying drawings.

In preferred embodiments of the present invention, an example wherein an ultraviolet curing material has been applied to a putty or a surfacer as a repairing material will be explained.

First, a step for filling a damaged part with a putty (forming a putty-filled surface 1) is simply described.

In the step for filling a damaged part with a putty, a pretreatment is effected in response to a state of such damaged part. An example of the pretreatment includes a degreasing treatment of a coating film 8 which has been originally applied (hereinafter referred also optionally to "old coating film"), a removing treatment of an old coating film, a forming treatment of a feather edge 7 and the like.

A degreasing treatment of an old coating film is a pretreatment which is executed in most cases in also an ordinary repairing process where no ultraviolet-curing resin is used.

Next, a removing treatment of an old film 8 differs from the degreasing treatment, and is applied to an old film extending over a damaged part and the periphery thereof in response to a condition of the damaged part. In the case where damage is in a concave configuration, an old film extending over the concave part is removed in most cases. On one hand, in the case where damage is in linear flaws, scratches, or pricks damaged by a nail and the like, an old coating film has already been removed. Hence, it is judged whether or not further removal of the old coating film 8 is necessary in accordance with a condition of the damage.

In this respect, a removing treatment of an old coating film being a conventional pretreatment may be carried out in accordance with a conventional manner by, for example, the use of a motor sanding machine such as disc sander, and double acting sander.

An operation for taking the feather edge 7 (operation for forming the feather edge 7) is executed simultaneously with or after the above described removing operation of the old coating film. The operation for taking the feather edge 7 is realized by applying a smooth slope to a coating film section, the slope extending from the old coating film to a steel sheet surface or a resin part surface which was exposed as a result of removing the old coating film. An angle of the slope ranges generally from about 27 to 54 degrees. The operation for forming a feather edge has been also carried out heretofore, and accordingly, a conventional manner may be adopted in the present embodiment. In this connection, an implement used therefor may be a double acting sander and the like.

Thereafter, the surface from which has been removed an old coating film and the periphery thereof are preferably washed by means of air blow or the like, and further the resulting surface and the periphery thereof are subjected to a degreasing treatment.

A putty material composed of an ultraviolet polymerizable composition is filled in a damaged part which has been subjected to pretreatments according to need as described above, and the putty material is cured with ultraviolet rays, whereby the damaged part is filled with the putty. An ultraviolet polymerizable composition used for such putty material may be the same ultraviolet polymerizable composition used ordinarily as a putty material for automobile or the like use and it is not particularly limited to specific materials. An ultraviolet polymerizable composition used generally for such putty material as described above contains, as indispensable components, an ultraviolet polymerizable prepolymer, an ultraviolet polymerizable monomer, and an ultraviolet polymerization initiator, and may further contain, as optional components, a sensitizer, a pigment, a filler, a defoamer, a surface modifier, a solvent and the like.

A specific example of the ultraviolet polymerizable prepolymer contained in the above described ultraviolet polymerizable composition includes a radical polymerization type prepolymer such as ester acrylates, urethane acrylates, epoxy acrylates, amino resin acrylates, acrylic resin acrylates, and unsaturated polyesters; a cationic polymerization type prepolymer such as epoxy resin, and resins containing vinyl ether; and a thiol-ene adduct type prepolymer prepared by combining an oligomer containing an aryl group or an acryloyl group at the molecular termination thereof with a polythiol.

Furthermore, a specific example of the ultraviolet polymerizable monomers includes radical monomers such as 2-ethylhexyl acrylate, ethoxydiethylene glycol acrylate, phenoxyethyl acrylate, 2-hydroxypropyl acrylate, tetrahydrofurfuryl acrylate, dicyclopentenyl acrylate, neopentylglycol diacrylate, polyethylene glycol diacrylate, bis (acryloxyethyl)bisphenol A, melimethylolpropane triacrylate, pentaerythritol triacrylate, and dipentaerythritol hexaacrylate; and cationic monomers such as vinylcyclohexene monoxide, hydroxybutyl vinyl ether, cyclohexane dimethanol divinyl ether, cyclohexene diepoxide, and caprolactone polyol.

A specific example of the ultraviolet polymerization initiators includes a variety of carbonyl compounds and the like as radical polymerization initiators; onium salts and the like as cationic polymerization initiators. Moreover, examples of an initiator for the thiol-ene adduct type prepolymers include hydrogen-pulling type initiators.

An ultraviolet polymerizable composition for a putty material is prepared by incorporating, for example, these indispensable components described herein in a suitable ratio of amounts as well as the above described optional components by a suitable amount, respectively, as occasion demands, with each other. An amount in a variety of components to be incorporated is suitably selected dependent upon a type or the like of the indispensable components used.

As an ultraviolet polymerizable composition for putty material, preferable is one containing about 20 to 30% by weight of an ultraviolet polymerizable prepolymer, about 15 to 30% by weight of an ultraviolet polymerizable monomer, about 1 to 10% by weight of an ultraviolet polymerization initiator, and about 40 to 60% by weight of a pigment with respect to the total amount of the composition. In this connection, a pigment used for the above described ultraviolet polymerizable composition is not particularly limited, but an extender pigment such as calcium carbonate, barium sulfate, clay, talc, polishing powder, white carbon, and valoon is generally employed.

Such a putty material is filled in a damaged part, the surface of which has been pretreated as occasion demands. Such filling-in of a putty material may be carried out in accordance with a conventional manner. In a preferred manner, a putty material is filled in a damaged part with a somewhat larger volume than that to be just filled over several times. A first suitable amount of the putty material is filled in the damaged part so as to squeeze the same into a concavity with use of a plastic spatula. Furthermore, a remaining amount of the putty material is divided into suitable sections, and each section of the putty material is successively recoated on the previous coated portion so as not to contain air therein by the use of the plastic spatula. After filling-in of the putty material, the resulting part filled with the putty material is slightly protuberant from the old coating film surface, so that a thickness of the putty material in the part filled with the putty material is around 0.1 to 1 mm thicker than that of the old coating film, and as a result, a thickness of the resulting part filled with the putty material is about 0.4 to 3 mm, depending on a thickness of the old coating film.

After completing filling-in of a putty material, ultraviolet rays are irradiated on the part filled with the putty material to cure the putty material, which is an ultraviolet polymerizable composition. Irradiation of ultraviolet rays may be executed by the use of, for example, a device which generates light rays containing ultraviolet rays such as a UV lamp. A period of time required for irradiating ultraviolet rays to cure an ultraviolet polymerizable composition is about 30 seconds to 60 seconds, provided that, for example, the above described preferred composition is used as a putty material, a thickness of a part filled with the putty material is within the above described range, and a sufficient amount of ultraviolet rays is irradiated.

As a result of irradiation of ultraviolet rays as described above, the putty material hardens, so that the above described damaged part which has been subjected to a pretreatment according to need is filled with the putty. In this case, when a volume of the putty material somewhat decreases as a result of curing, there is such a case where protuberance from the old coating film surface somewhat decreases as compared with that before the putty material is cured.

Thereafter, a putty surface protuberant from the old coating film surface is sanded with a sanding tool to make the same flush with the old coating film surface.

A structure of a sanding tool is, as shown in FIG. 1, composed of a base plate 3 on the bottom surface of which sandpaper 2 is exchangeably stretched and which is positioned at the central portion of the sanding tool, and movable base plates 4 and 4 are disposed on the opposite sides of the base plate 3, respectively, so as to be bendable.

Figure 2:
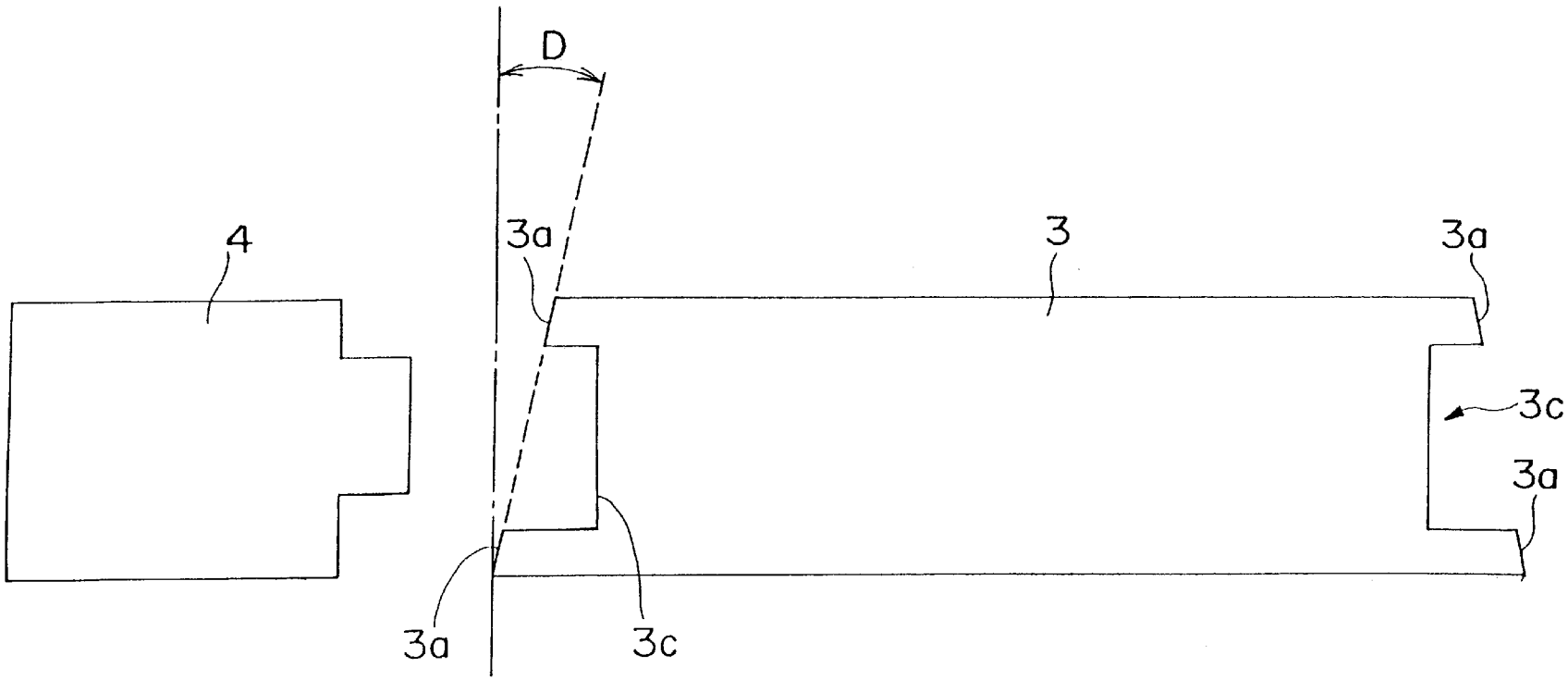
FIG. 2 is a front view wherein the sanding tool according to the embodiment is partially exploded.

As shown in FIG. 2, the base plate 3 has a trapezoidal section viewed from the front thereof, and the opposite sides thereof are notched, respectively, to define inclined sections 3*a* and 3*a* on either side of the trapezoidal section. A tilt angle D of the inclined sections 3*a* and 3*a* is 5.5 degrees. The base plate 3 is integrally molded from polyvinyl chloride, ABS, polycarbonate or the like so as to have 12 mm thickness, and a long side of the trapezoid is about four times longer than a short side. In this connection, the base plate 3 may be prepared from wood.

A grip 55 is disposed on the top of the base plate 3. Two types of the grip 55 are prepared. One type of grip is a wide grip used for both hands, and the other is a narrow grip used for a single hand.

Moreover, seven bolt holes 3*b* are defined on each side of the base plate 3. A coil spring chamber 3*c* is further defined around the bolt hole 3*b*.

To the opposite sides of the base plate 3 along the longitudinal direction thereof are attached movable base plates 4 and 4, respectively. The movable base plate 4 is prepared from the same material as that of the base plate 3 with the same thickness as that of the base plate 3. These movable base plates 4 and 4 are bendably attached to the base plate 3 with bolts 5, 5, . . . respectively. It is to be noted that the bolt 5 is the one used for a hexagonal wrench.

Figure 4:
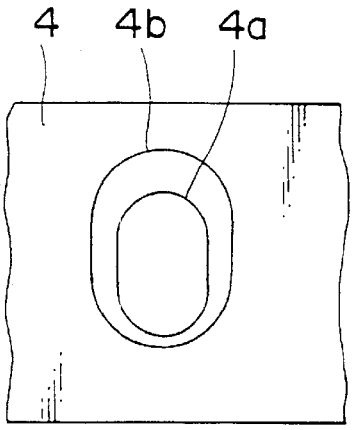
FIG. 4 is a sectional view showing a partially enlarged sanding tool according to the embodiment.
Figure 5:
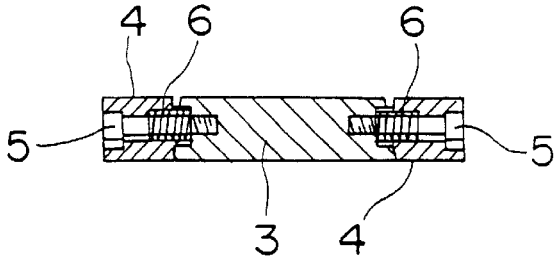
FIG. 5 is a cross-sectional view showing the sanding tool according to the embodiment.
Figure 6:
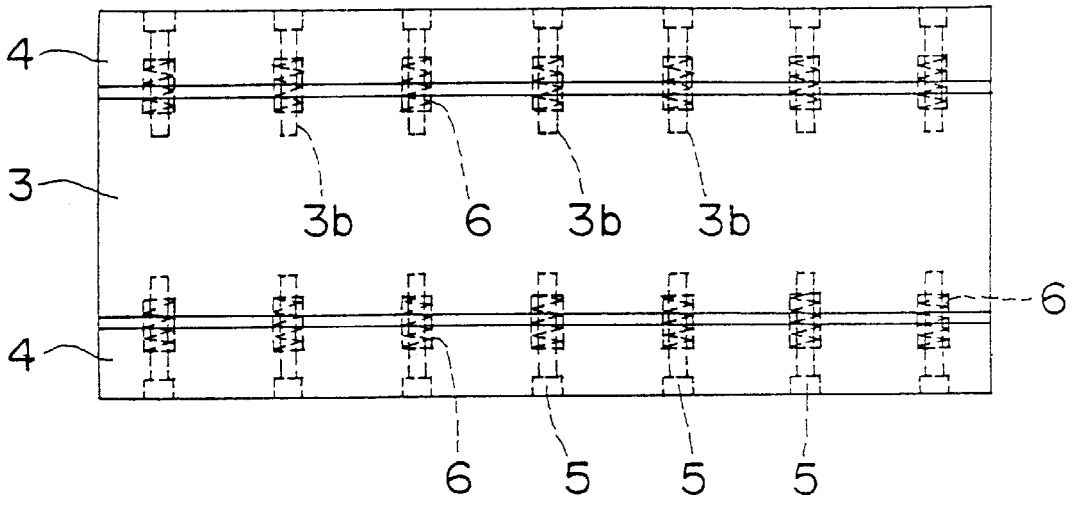
FIG. 6 is a planar view showing an internal structure of the sanding tool according to the embodiment.
Figure 7:
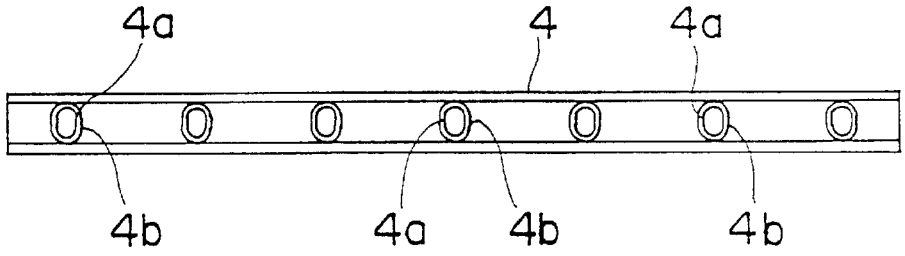
FIG. 7 is a side view showing the whole of the sanding tool according to the embodiment.
Figure 8:
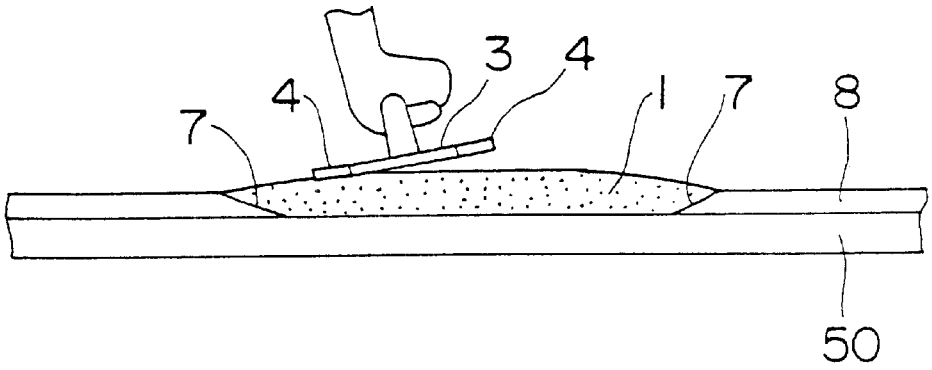
FIG. 8 is a sectional view showing the sanding tool according to the embodiment in use.

A bolt insertion hole 4a for inserting the bolt 5 into the movable base plate 4 is defined thereon. Furthermore, a concave 4*b* is defined in the opening of the bolt insertion hole 4*a* for seating a bolt head of the bolt 5 therein. In these circumstances, the bolt insertion hole 4*a* and the concave 4*b* are defined into an elongated hole extending along the longitudinal direction thereof so as to permit movement of the movable base plate 4 as shown in FIG. 4, respectively. Further, a coil spring 6 is inserted into a space defined by the base plate 3 and the movable plate 4 where they are in contact with each other.

Figure 3:
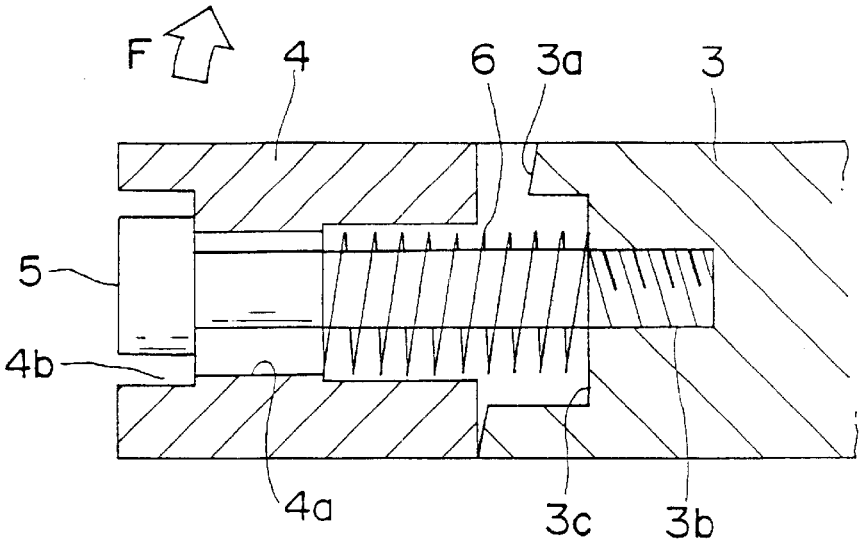
FIG. 3 is a sectional view showing a bending part of the sanding tool according to the embodiment.

Thus, a positional relationship determined by the base plate 3 and the movable base plate 4 is such that these base plates 3 and 4 can be relatively bent in the direction shown by an arrow F with a limitation of 5.5 degrees as shown in FIG. 3. In this constitution, when a pressing force onto the movable base plate 4 is removed, the movable base plate 4 returns to the direction where the movable base plate 4 becomes flush with the base plate 3 due to elastic force of the coil spring 6.

An adhesive-backed sheet is bonded to each bottom of the base plate 3 as well as the movable base plates 4 and 4, so that sandpaper 2 can be held detachably on these bottoms. More specifically, an adhesive surface (either surface) of a single adhesive-backed sheet is bonded and fixed to the base plate 3 as well as both the movable base plates 4 and 4 in the side with which a sanding operation is effected so as to be flush with each other. On the other surface of the adhesive-backed sheet is applied a linear and fine concavo-convex pattern, so that the sandpaper 2 the back of which has been applied an adhesive is detachably held thereon.

A movable range of the movable base plate 4 may be arbitrarily set from the same level as that of the base plate (0 degree) to 10 degrees with respect thereto. Setting of an inclinable angle is performed by varying an angle of the inclined section 3*a,* and a gap defined between the concave 4*b* and the bolt head of the bolt 5.

The above described sanding tool for putty surface may be constituted into either a shape wherein the tool can be operated by holding with an operator's hand, or a shape wherein the sanding tool can be detachably attached to an electrically-driven device such as a double acting sander, an orbital sander, and a straight sander. An adapter for attaching the present sanding tool to these power assisting type sanders may be arranged in such that the base plate 3 and the movable base plate 4 are rotated in increments of 90 degrees thereby to be changeable an angle. As a consequence, a sanding operation can be effected in the most effective direction in response to a site to be sanded or a posture of an operator.

In the case where the present sanding tool is actually employed, a sanding operation is performed while allowing the movable base plate 4 to be suitably in contact with a putty surface 1 to be sanded as shown in FIGS. 1 and 2. In the case where the putty surface 1 is a flat surface, although the surface maybe sanded with the base plate 3, if it is difficult to produce a pertinent plane, fine concave portions may be sanded with the movable base plate 4.

Figure 9:
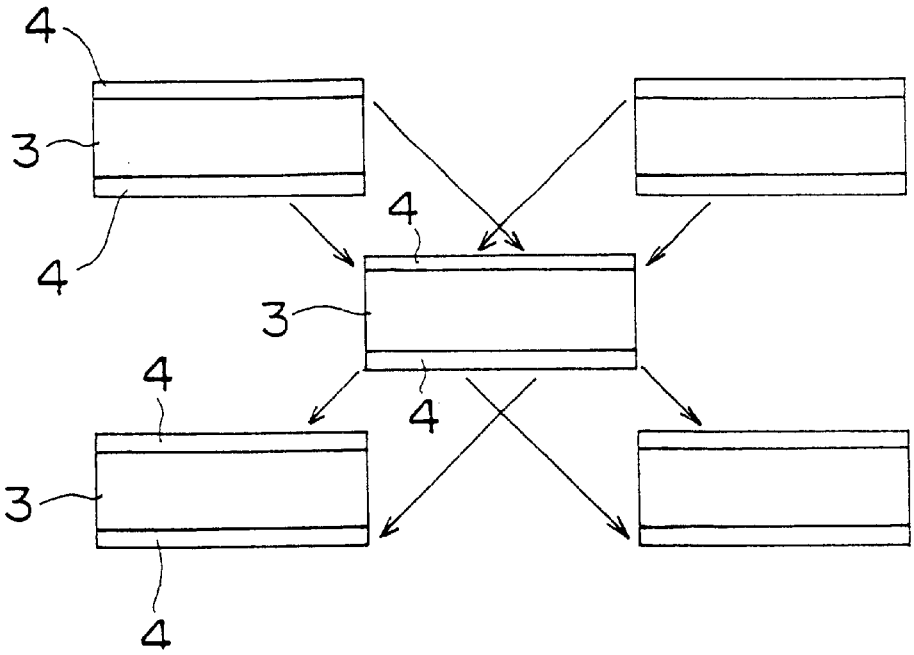
FIG. 9 is a planar view for explaining the sanding tool according to the embodiment in use.
Figure 10:
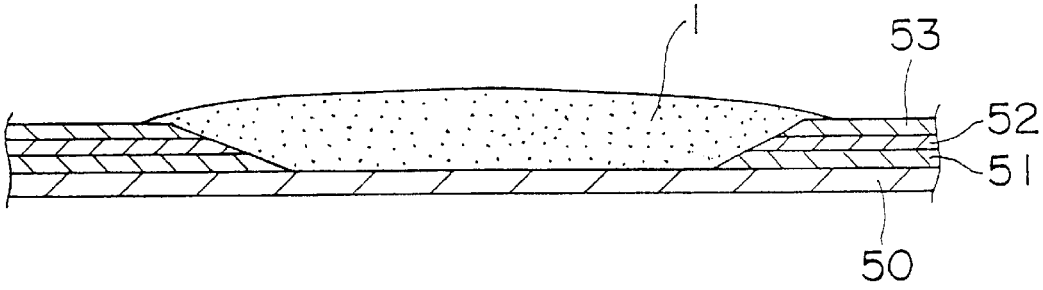
FIG. 10 is a sectional view showing a putty-filled surface applied to a vehicle.
Figure 11:
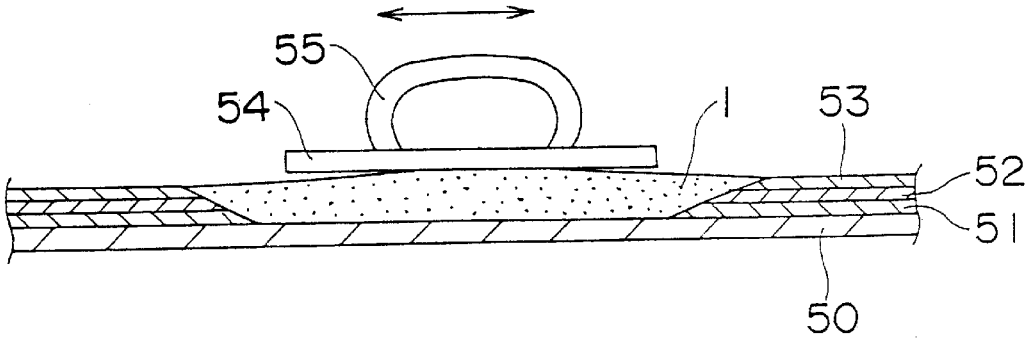
FIG. 11 is a sectional view showing a general sanding state of a putty-filled surface applied to a vehicle.

A sanding operation which is performed by the use of the sanding tool according to the present invention is carried out in accordance with, for example, an operational procedure of a cross hand-like pattern as shown in FIG. 9. In this case, although sanding is realized by one of edge portion (the movable base plate 4) in the sanding tool, since the movable base plate 4 has a certain width, a stable sanding operation can be carried out even if the sanding operation is linear motion. Moreover, a pressing force of the movable base plate 4 functions with respect to a putty surface as a result of transmitting the force from the larger base plate 3 to which has been attached the grip 55 to the smaller movable base plate 4. Accordingly, the movable base plate 4 is pressed uniformly against the putty surface without any unevenness. In practice of the present sanding tool, it is desirable that in the case where an operator intends to sand a putty surface in such a manner that the sanding tool is pushed from the operator's side towards the outside, the sanding is executed by allowing the movable base plate 4 on the operator's side to be forcibly in contact with a surface to be repaired, while it is also desirable that in the case where an operator intends to sand a putty surface in such a manner that the sanding is operated from the outside towards the operator's side, the sanding is executed by allowing the movable base plate 4 on the outer side to be forcibly in contact with a surface to be repaired.

In the case of sanding, it is a general rule that several types of sandpaper degrees of which extend over around No. 80 to No. 180 in coarseness of sanded surface are gradually exchanged, and no rapid sanding operation is carried out.

Then, on such flattened putty surface 1 is formed a primer surfacer layer. In this case, it is preferred that such primer surfacer layer is also formed on a boundary part defined by putty and an old coating film. More preferable is that the primer surfacer layer has a constant thickest thickness in the vicinity defined between the putty and the old coating film as well as on the putty itself, and it is formed such that a thickness of the layer becomes gradually thinner in response to increase of a distance from the vicinity of the boundary.

A primer surface layer is prepared by spray coating homogeneously a primer surfacer raw material composed of an ultraviolet polymerizable composition and having a viscosity in which the raw material can be spray coated onto a surface to be coated which contains the above described putty exposed surface, and the raw material coating film thus obtained is subjected to ultraviolet ray curing.

Finally, a coating is applied to the primer surfacer layer, whereby a repair of a damaged part is completed.

The present invention is not limited to the embodiments as described above. It will be appreciated by those of ordinary skill in the art that the present invention can be embodied in other specific forms without departing from the spirit or essential characteristics thereof.

What is claimed is:

1. A sanding tool for sanding a surface of a repaired plane into a predetermined condition, comprising:

a base plate having two side edges and having a front face side to which sandpaper can be attached; and at least one separate, movable base plate which is movably mounted at a side edge of said base plate said movable base plate having a front face side to which sandpaper can be attached;

said at least one movable base plate being resiliently biased in a direction wherein said front face side of said movable base plate becomes coplanar with said front face side of said base plate.

2. A sanding tool as claimed in claim 1, wherein:

a range of movement of said movable base plate is within a range where an angle defined by said front face side of said at least one movable base plate relative to said front face side of said base plate is from about 170 degrees to about 180 degrees.

3. A sanding tool as claimed in claim 1, wherein:

a resilient means for resiliently biasing said at least one movable base plate in said direction is disposed between said base plate and said movable base plate.

4. A sanding tool as claimed in claim 1, wherein:

said front face side of said at least one movable base plate is smaller than said front face side of said base plate.

5. A sanding tool as claimed in claim 1, wherein:

said front face side of said at least one movable base plate is rectangular and said front face side of said base plate is rectangular.

6. A sanding tool as claimed in claim 1, wherein:

said one movable base plate is disposed on a first side edge of said base plate and a second separate, movable base plate is disposed on a second side edge of said base plate, opposite said first side edge.

* * * * *